US005285214A

United States Patent [19]

Bowry

[11] Patent Number: 5,285,214

[45] Date of Patent: Feb. 8, 1994

[54] APPARATUS AND METHOD FOR DRIVING A FERROELECTRIC LIQUID CRYSTAL DEVICE

[75] Inventor: Carolyn Bowry, Birmingham, England

[73] Assignee: The General Electric Company, p.l.c., United Kingdom

[21] Appl. No.: 865,697

[22] Filed: Apr. 8, 1992

Related U.S. Application Data

[63] Continuation of Ser. No. 340,296, Apr. 5, 1989, abandoned.

[30] Foreign Application Priority Data

Aug. 12, 1987 [GB] United Kingdom ..... 8719078

[51] Int. Cl.[5] ..... G09G 3/36

[52] U.S. Cl. ..... 345/97; 345/208; 359/56

[58] Field of Search ..... 340/802, 805, 807, 784, 340/789, 811, 718, 719; 359/54, 55, 56; 350/332, 333, 350 S

[56] References Cited

U.S. PATENT DOCUMENTS

| | | | |
|---|---|---|---|
| 3,995,942 | 12/1976 | Kawakami et al. | 340/784 |
| 4,508,429 | 4/1985 | Nage et al. | 340/805 |
| 4,681,404 | 7/1987 | Okada et al. | 340/784 |
| 4,705,345 | 11/1987 | Ayliffe et al. | 340/784 |
| 4,830,467 | 5/1989 | Inoue et al. | 350/332 |
| 4,909,607 | 3/1990 | Ross | 340/811 |

FOREIGN PATENT DOCUMENTS

| | | |
|---|---|---|
| 0229647 | 7/1987 | European Pat. Off. . |
| 0257131 | 9/1987 | Japan . |
| 0249130 | 10/1988 | Japan . |
| 0172819 | 7/1989 | Japan . |

*Primary Examiner*—Alvin E. Oberley
*Assistant Examiner*—Chanh Nguyen
*Attorney, Agent, or Firm*—Kirschstein et al.

[57] ABSTRACT

In a method of driving a matrix of ferroelectric liquid crystal devices in a TDM mode, each strobing signal comprises first and second pulses (20,21) of opposite polarities and of different amplitudes, together with a dc voltage (26) which is applied from the end of the second pulse to the beginning of the first pulse of the next strobing signal on the same strobe line to cancel the dc level which would be caused by the unequal pulses. Data ON signals applied selectively to data lines of the matrix comprise two consecutive pulses (22,23) of opposite polarities. Data OFF signals (24,25) may be the inverse of the data ON signals or may comprise a constant dc level. The combination of the two pulses with a dc level to form each strobing signal means that only two strobe pulse time slots per frame are required for addressing each strobe line, as compared with the conventional systems in which four time slots per frame are required.

9 Claims, 5 Drawing Sheets

APPARATUS AND METHOD FOR DRIVING A FERROELECTRIC LIQUID CRYSTAL DEVICE

This is a continuation of application Ser. No. 07/340,296, filed on Apr. 5, 1989, now abandoned.

BACKGROUND OF THE INVENTION

1. Field of the Invention

This invention relates to ferroelectric liquid crystal (FLC) devices, and particularly to a method and apparatus for driving the liquid crystal elements of such devices.

2. Description of Related Art

A ferroelectric liquid crystal has a permanent electric dipole which interacts with the applied electric field. Hence, ferroelectric liquid crystals exhibit fast response times, which make them suitable for use in display, switching and information processing applications. An example of an FLC device is described in a paper by N. A. Clarke et al, entitled "Submicrosecond bistable electro-optic switching in liquid crystals" in Appl. Phys. Lett. Volume 36, 1980, pp 899-901.

The stimulus to which an FLC device responds is a dc field, and its response is a function of the applied voltage (V) and the length of time (t) for which it is applied. The response is not a linear function of $V \times t$, and there may be a voltage level at which, irrespective of the length of time for which the voltage is applied, switching of the device will not occur. There may also be a length of time of application of the voltage which will be too short for switching to occur, irrespective of the magnitude of the voltage.

An FLC device which can be miltiplexed needs to have at least two different states (called latched states) which the liquid crystal can adopt in the absence of an applied field. These can be the same states as the states (called switched states) obtained when a field of either polarity is applied, or they can be different states.

The liquid crystal can change from one switched state to another switched state when a field is applied thereto, without necessarily going to a latched state when the field is removed.

For a given time interval, the voltage at which the liquid crystal switches from one state to the other by 10% is called the switching threshold at 10% switching ($T_{S10}$). The voltage at which the liquid crystal switches fully from one state to the other state is called the switching threshold at 100% switching ($T_{S100}$). The voltage at which the liquid crystal will go fully into one of the latched states when the field is removed is called the latching threshold at 100% latching ($T_{L100}$). The voltage at which the liquid crystal no longer goes into either of two different states when the field is removed is called the latching threshold at 0% latching ($T_{Lo}$).

A ferroelectric liquid crystal element is switched to one state by the application of a voltage of a given polarity across its electrodes, and is switched to the other state by the application thereto of a voltage of the opposite polarity. It is essential that an overall dc voltage shall not be applied across such an element for an appreciable period, so that the elements remain charge-balanced, thereby avoiding decomposition of the crystal material. Pulsed operation of such elements has therefore been effected, with a pulse of one polarity being immediately followed by a pulse of the other polarity, so that there is no resultant dc polarisation.

The liquid crystal elements are commonly arranged in matrix formation and are operated selectively by energising relevant row and column lines. Time-division multiplexing is effected by applying pulses cyclically to the row (strobe) lines in sequence and by applying pulses, in synchronism therewith, to selected column (data) lines.

An example of an FLC display driving system is disclosed in an article by T. Harada, M. Taguchi, K. Iwasa and M. Kai in SID 85 Digest, p 131 et seq. This system uses four pulses per refresh cycle, and can therefore be classified as a 4 time slot system. For a 625-line display at video frame rates this would require a 16 $\mu$s response of the crystal elements.

SUMMARY OF THE INVENTION

It is an object of the present invention to provide a method and apparatus for driving the elements of an FLC device matrix, in which only two strobe pulse time slots per frame are required.

According to one aspect of the invention there is provided a method of driving a ferroelectric liquid crystal device matrix in a time-division multiplex mode, comprising applying strobing signals cyclically to strobe lines coupled to two-state liquid crystal elements of the display and applying data signals selectively to data lines coupled to the elements, wherein each strobing signal comprises a first pulse of one polarity followed by a second pulse of the opposite polarity and of different amplitude from the first pulse, and a dc voltage which is effective during a period between the end of the second pulse of a strobing signal and the beginning of the first pulse of the next strobing signal applied to the same strobe line to substantially cancel a dc voltage level resulting from the difference between the amplitudes of the first and second pulses and which will not switch the liquid crystal elements during this period, wherein the data signals comprise a first data signal operative in combination with the strobing signal to set a selected liquid crystal element in a first one of its states, and a second data signal operative in combination with the strobing signal to set the selected liquid crystal element in the other of its states, and wherein one or each of the first and second data signals comprises at least two consecutive pulses of opposite polarities and of substantially equal amplitudes.

According to another aspect of the invention there is provided apparatus for driving a ferroelectric liquid crystal device matrix in a time-division multiplex mode, comprising means to apply strobing signals cyclically to strobe lines coupled to two-state liquid crystal elements of the display; and means to apply data signals selectively to data lines coupled to the elements, wherein each strobing signal comprises a first pulse of one polarity followed by a second pulse of the opposite polarity and of different amplitude from the first pulse, and a dc voltage which is effective during a period between the end of the second pulse of a said strobing signal and the beginning of the first pulse of the next strobing signal applied to the same strobe line to substantially cancel a dc voltage level resulting from the difference between the amplitudes of the first and second pulses, which dc voltage will not switch the liquid crystal elements during said period, wherein the data signals comprise a first data signal operative in combination with the strobing signal to set a selected liquid crystal element in a first one of its states, and a second data signal operative in combination with the strobing signal to set the selected liquid crystal element in the other of its states, and wherein one or each of the first and second data signals comprises at least two consecutive pulses of opposite polarities and of substantially equal amplitudes.

BRIEF DESCRIPTION OF THE DRAWINGS

Embodiments of the invention will now be described, by way of example, with reference to the accompanying drawings, wherein.

DETAILED DESCRIPTION OF THE PREFERRED EMBODIMENTS

Figure 1:
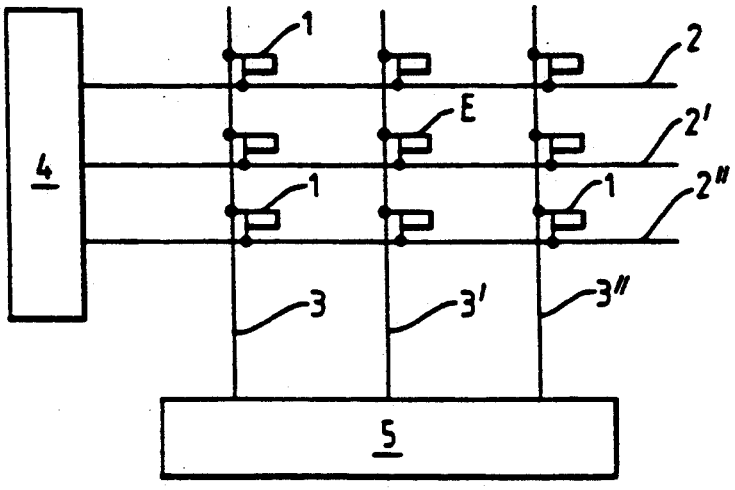
FIG. 1 is a block schematic diagram of an FLC device drive system.

Referring to FIG. 1, a ferroelectric liquid crystal device, such as display, comprises a matrix of ferroelectric liquid crystal elements 1 coupled to row (strobe) and column (data) lines 2 and 3, respectively. For the sake of example, nine of such elements coupled to three strobe lines and three data lines are shown, but there may be any desired number of elements and corresponding lines. A strobe pulse generator 4 is coupled to the strobe lines, and a data pulse generator 5 is coupled to the data lines. The strobe pulse generator continuously applies strobing signals to the strobe lines 2 in sequence, and the data pulse generator applies data signals to the data lines 3, in synchronism with the pulsing of the strobe lines, to set the corresponding element 1 in the required state.

Figure 2A:
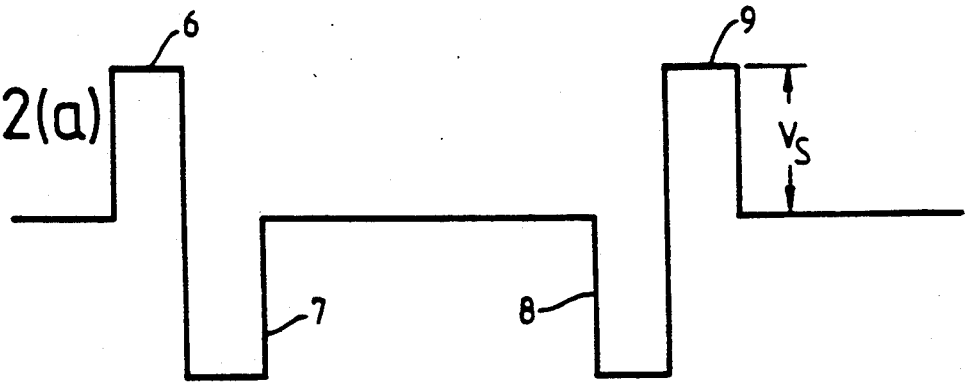
FIGS. 2(*a*)–2(*c*) illustrates strobing and data pulses occurring in a known 4-slot drive system.
Figure 2B:
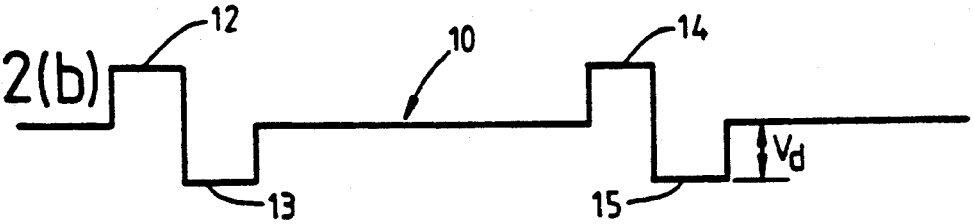
Figure 2C:
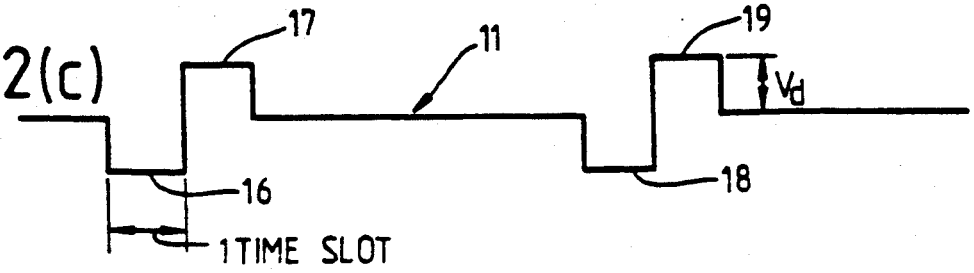
Figure 3A:
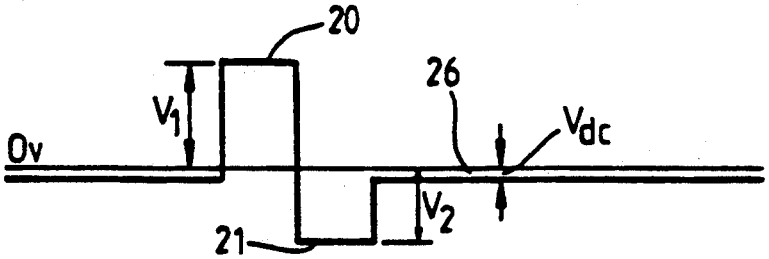
FIGS. 3(*a*)–3(*e*) illustrates strobing and data pulses occurring in one embodiment of a 2-slot drive system according to the present invention.
Figure 3B:
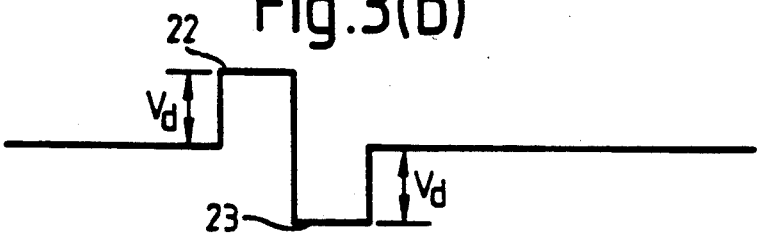
Figure 3C:
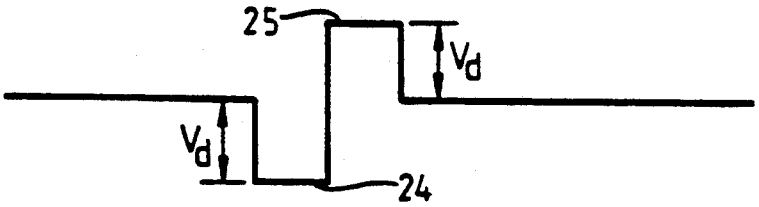
Figure 3D:
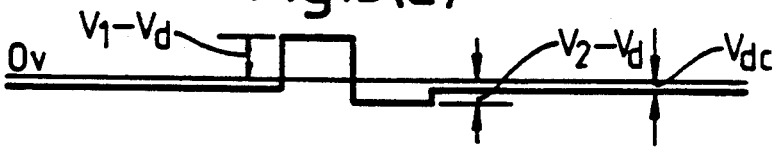
Figure 3E:
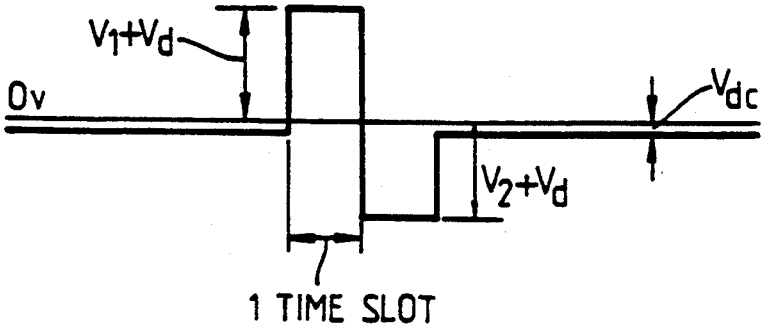

FIG. 2 shows waveforms which would be applied to the lines 2 and 3 in a known 4-slot drive system. In FIG. 2(*a*), a strobing signal comprises a positive pulse 6 followed by a negative pulse 7 and, later during the same frame period, a negative pulse 8 followed by a positive pulse 9. All of these pulses are of the same amplitude $V_R$, and there is therefore no residual dc level. The data signal may comprise a pulse train 10 (FIG. 2(*b*)) for setting the addressed element in the ON state or a pulse train 11 (FIG. 2(*c*)) for setting it in the OFF state, where ON and OFF merely indicate two different states. The pulse train 10 comprises positive and negative pulses 12 and 13, respectively, coincident with the pulses 6 and 7, and positive and negative pulses 14 and 15, respectively, coincident with the pulses 8 and 9. The pulses 12, 13, 14 and 15 are all of amplitude $V_d$. The pulse train 11 comprises pulses 16, 17, 18 and 19 of the same amplitude as the pulses 12, 13, 14 and 15 but of opposite polarity thereto.

The data pulses are also applied via the lines 3 to those liquid crystal elements 1 which are not being addressed by the strobing signal. This leads to crosstalk, which is inherent in any mltiplexing scheme. In order to reduce visible crosstalk effects there are certain conditions which a multiplexing scheme must satisfy, as follows 1. The data voltage $V_d$ must not be large enough to switch the liquid crystal. Switching the liquid crystal will reduce the contrast of the device.

i.e. $V_d \leqq T_{So}$

2. The strobe voltage plus the data voltage ($V_S+V_d$) must be large enough to switch and latch the liquid crystal so that the correct state (ON or OFF) of the element is achieved.

i.e. $V_S+V_d \geqq T_{L100}$

3. The strobe voltage minus the data voltage ($V_S-V_d$) can switch the liquid crystal since it occcurs only once in every frame scan. However, it must not latch the liquid crystal, since this will reverse the data required, nor must it unlatch the liquid crystal from the original state.

i.e. $V_S-V_d \leqq T_{Lo}$

FIG. 3 shows waveform provided in a first embodiment of the present invention. The strobing signal (FIG. 3(*a*)) comprises a positive pulse 20 of amplitude $V_1$, followed by a negative pulse 21 of amplitude $V_2$, which is less than $V_1$. This is the only pair of strobe pulses occurring during a frame period. The data signal comprises either a positive pulse 22 followed by a negative pulse 23 (FIG. 3(*b*)) or a negative pulse 24 followed by a positive pulse 25, depending upon the data to be written. The pulses 22–25 are all of amplitude $V_d$ (not necessarily equal to $V_d$ of FIG. 2).

Since the strobe pulses 20 and 21 are of different amplitudes, there would be a residual dc level applied to the addressed liquid crystal elements and, as stated above, this is undesirable. In the present invention, therefore, a small dc voltage 26 is applied to the strobe line between the end of the pulse 21 and the beginning of the pulse 20 of the next frame period.

FIG. 3(*d*) shows the voltage appearing across the addressed liquid crystal element as a result of the strobe signal and the data signal of FIG. 3(*b*), whilst FIG. 3(*e*) similarly shows the resultant, but for the data signal of FIG. 3(*c*). For the system to operate correctly, the following conditions should be satisfied as nearly as possible. The system can operate without their being satisfied, but there is then a loss of contrast.

$V_1-V_d > T_{L100}$
$V_2-V_d < T_{Lo}$
$V_2+V_d > T_{L100}$
$V_d < T_{So}$

It will be seen that each strobe and data signal comprises only two pulses, so that the liquid crytal elements are addressed in only two time slots during a frame period, as compared to four time slots for the known system. This halves the requirement as regards the speed of switching of the liquid crystal elements.

Figure 4A:
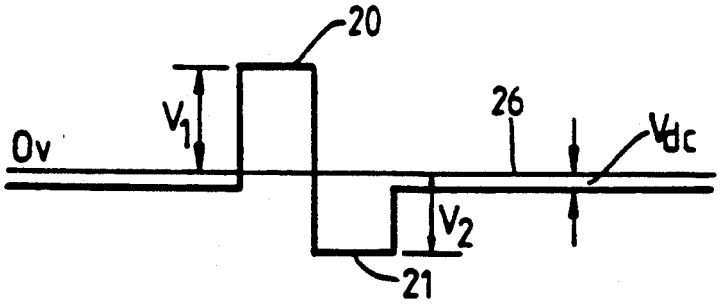
FIGS. 4(*a*)–4(*c*), 5(*a*)–5(*c*), 6(*a*)–6(*c*), 7(*a*)–7(*c*), 8(*a*)–8(*c*), 9(*a*)–9(*c*) to 10 illustrate strobing and data pulses occurring in second to eighth embodiments, respectively, of the invention.
Figure 4B:
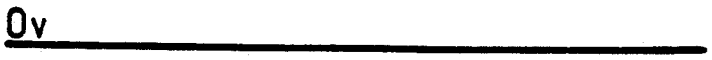
Figure 4C:
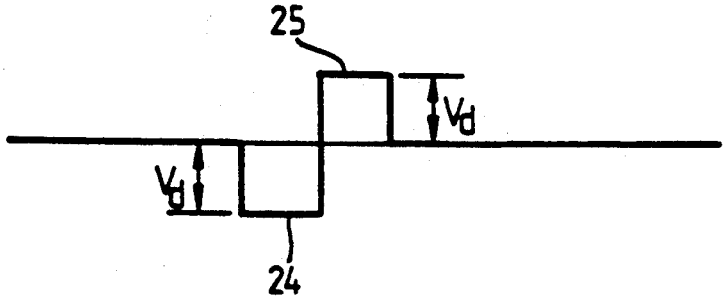

FIG. 4 shows an alternative arrangement of data pulses. The strobe pulses (FIG. 4 (*a*)) are similar to those in FIG. 3(*a*), and the data OFF pulses (FIG. 4 (*c*)) are similar to those in FIG. 3(*c*). In this case, however, the data ON signal (FIG. 3(*b*)) comprises merely a zero voltage level. The various voltages must then satisfy the following conditions.

$V_1 > T_{L100}$
$V_2 < T_{Lo}$
$V_2+V_d > T_{L100}$
$V_d < T_{So}$

Figure 5A:
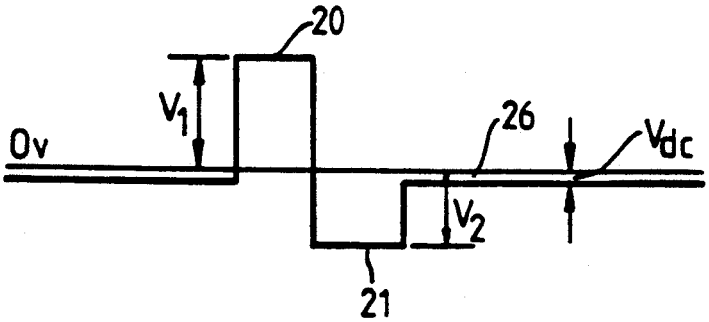
Figure 5B:
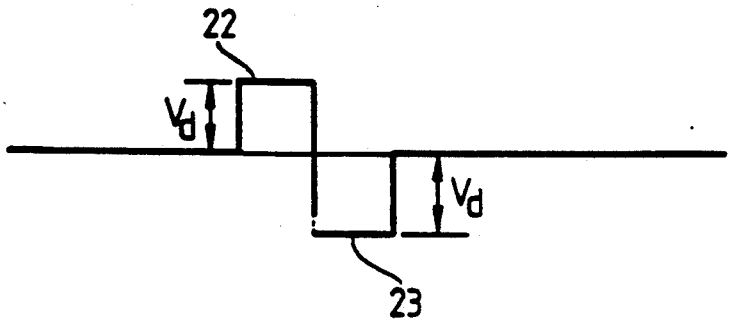
Figure 5C:
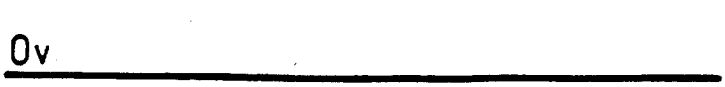

FIG. 5 shows another alternative arrangement of data pulses. In this case the data ON pulses (FIG. 5(*b*)) are similar to the data ON pulses of FIG. 3(*b*), but the data OFF signal (FIG. 5(*c*)) is merely a zero voltage level. The voltages must then satisfy the following conditions.

$V_1 - V_d > T_{L100}$
$V_2 - V_d < T_{Lo}$
$V_2 > T_{L100}$
$V_d < T_{So}$

In each of the drive arrangements described above, the duration of the element-addressing time can be shortened by reducing the period (t) of either of the strobe pulses and by increasing the voltage (V) of each reduced-length pulse, taking into account the criteria mentioned hereinbefore.

Figure 6A:
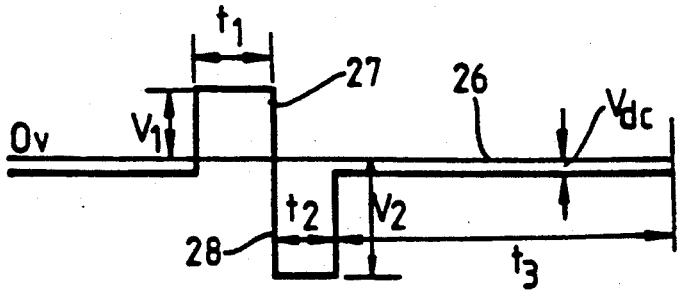
Figure 6B:
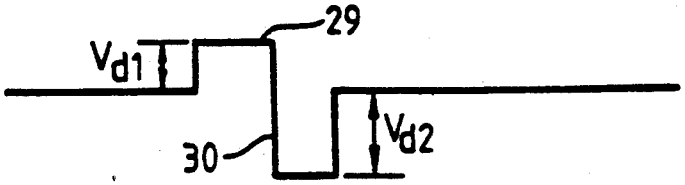
Figure 6C:
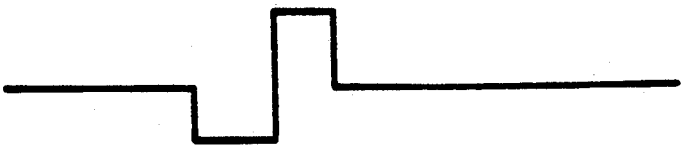

FIG. 6 shows one such configuration of strobe and data pulses. In FIG. 6(*a*), a first strobe pulse 27 has an amplitude $V_1$ and a period $t_1$, whereas a second strobe pulse 28 has a period $t_2$ which is shorter than $t_1$, and an amplitude $V_2$ which is larger than $V_1$. It will be apparent that $V_1 \times t_1 + V_2 \times t_2 + V_{dc} \times t_3$ must be substantially zero, where $t_3$ is the length of the period between the end of the pulse 28 and the beginning of the next pulse 27.

The data ON signal, shown in FIG. 6(*b*) comprises a positive-going pulse 29 of amplitude $V_{d1}$ and duration $t_1$, and a negative-going pulse 30 of amplitude $V_{d2}$ and duration $t_2$. The data OFF signal, shown in FIG. 6(*c*), is the inverse of FIG. 6(*b*). In order to avoid subjecting the liquid crystal elements to an overall dc level due to the application of the data pulses, $V_{d1} \times t_1$ must be equal to $V_{d2} \times t_2$ for each data signal.

The voltages and periods of the strobe and data pulses are preferably selected to obtain optimum working of the liquid crystal elements. The optimum arrangement for the strobe pulses is achieved when $V_1 = V_2$ and $t_1$ and $t_2$ are adjusted to suit the liquid crystal elements. Any discrepancy between $V_1 \times t_1$ and $V_2 \times t_2$ is then accounted for by selecting the correct value of the dc voltage 26.

Figure 7A:
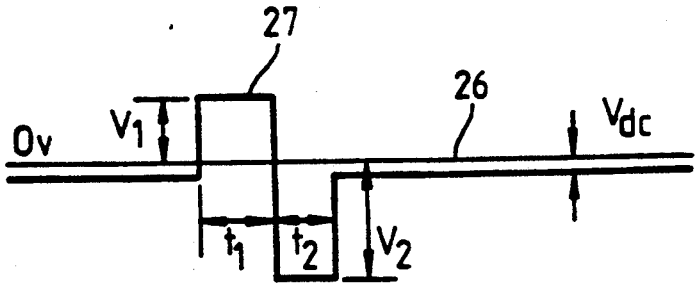
Figure 7B:
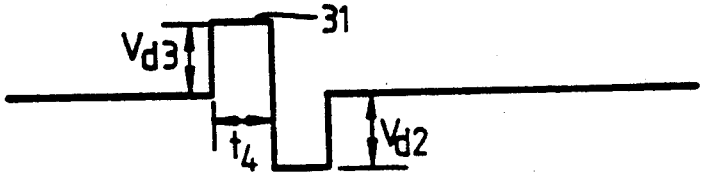
Figure 7C:
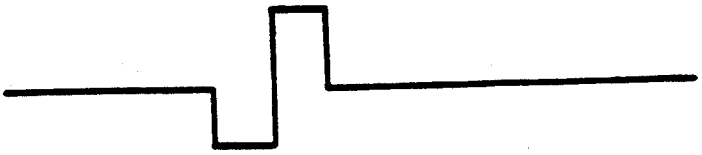

FIG. 7 shows an alternative pulse configuration in which the strobe pulses are the same as in FIG. 6, but the first data pulse 31 is of different period from the first strobe pulse 27. The pulse 31 begins later than the beginning of the strobe pulse 27, but the pulses end simultaneously. Again, the data OFF signal of FIG. 7(*c*) is the inverse of the data ON signal of FIG. 7(*b*). In this case $V_{d3} \times t_4$ must equal $V_{d2} \times t_2$ where $V_{d3}$ and $t_4$ are the amplitude and the period, respectively, of the pulse 31.

Figure 8A:
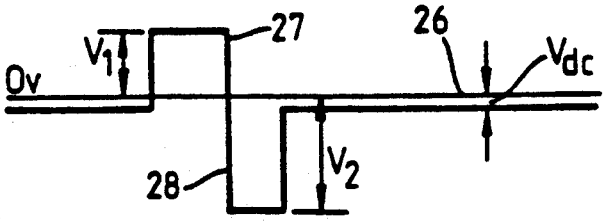
Figure 8B:
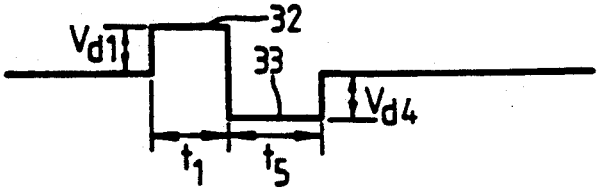
Figure 8C:
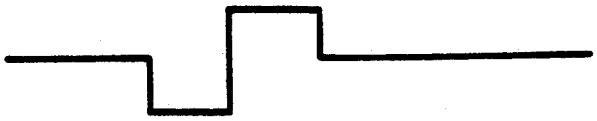

FIG. 8 shows another pulse configuration in which the strobe pulses are the same as in FIG. 6. In this case, however, the first data pulse 32 is the same width as the first strobe pulse 27, but the second data pulse 33 is longer than the second strobe pulse 28. The pulse 33 may alternatively be shorter than the pulse 28. For dc cancellation, $V_{d4} \times t_5$ must equal $V_{d1} \times t_1$, where $V_{d4}$ and $t_5$ are the voltage and period, respectively, of the pulse 33.

Figure 9A:
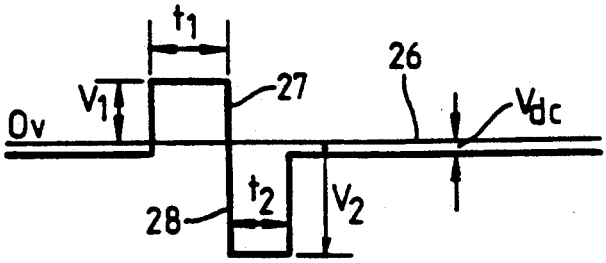
Figure 9B:
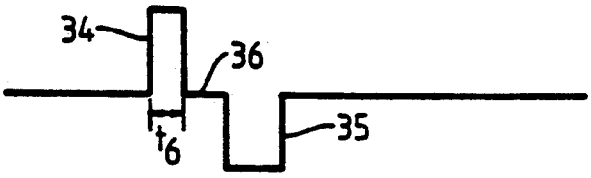
Figure 9C:
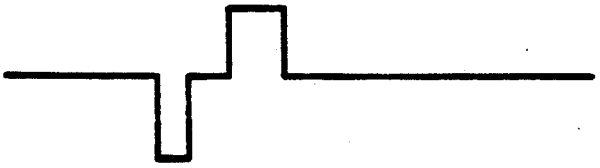

FIG. 9 shows another alternative configuration, in which the first data pulse 34 begins simultaneously with the first strobe pulse, but the data pulse is shorter than the strobe pulse. The second data pulse 35 is the same length as the second strobe pulse.

Figure 10:
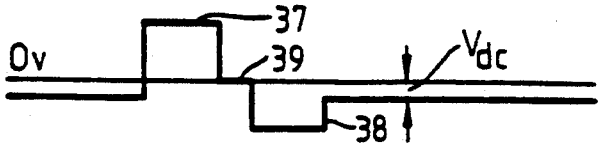

In each of the drive arrangements described herein, the performance of the FLC device may be improved by including a period of zero voltage between the positive and negative strobe and/or data pulses and/or before and/or after any of those pulses. The zero voltage period can be of any suitable length and should be selected to suit the particular liquid crystal elements. Such a zero voltage level may be as shown at 36 in the data signal in FIG. 9 or as shown in FIG. 10, wherein the first and second strobe pulses 37 and 38, respectively, are separated by a period 39 of zero voltage.

In every case, the pulse voltages and lengths will be adjusted to suit the particular type of liquid crystal elements and the particular combination of strobing and data signals. In any of the configurations described above, the polarity of both the strobe pulses and the data pulses may be reversed.

In each of the drive arrangements of the present invention a further improvement may be effected by superimposing an ac voltage at, say, 10–100 kHz on the pulses. This helps to sharpen the switching thresholds and may also improve the contrast ratio of the data ON and OFF states during multiplexing.

I claim:

1. A method of driving a ferroelectric liquid crystal device matrix in a time-division multiplex mode, comprising the steps of: applying strobing signals cyclically to strobe lines coupled to two-state liquid crystal elements of the display; and applying data signals selectively to data lines coupled to the elements; wherein each strobing signal comprises, during each frame period, only two strobe pulse periods, during which there are a first pule of one polarity followed by a second pulse of the opposite polarity and of different amplitude and/or duration from the first pule, each strobing signal including, between successive frame periods, a dc voltage which is effective during a period between the end of the second strobe pulse of a said strobing signal and the beginning of the first strobe pulse of the next strobing signal applied to the same strobe line to substantially cancel a dc voltage level resulting from the difference between the amplitudes and/or durations of the first and second strobe pulses, and which dc voltage will not switch the liquid crystal elements during said period; wherein the data signals comprise selectively a first data signal or a second data signal, said first data signal being operative in combination with the strobing signal to set a selected liquid crystal element in a first one of its states, and said second data signal being operative in combination with the strobing signal to set the selected liquid crystal element in the other of its states; and wherein one or each of the first and second data signals comprises two consecutive pulses of opposite polarities, there being only two data pulse periods in a frame period, said data pulse periods being substantially coincident with the strobe pulse periods.

2. A method as claimed in claim 1, wherein said first data signal comprises two consecutive pulses of mutually opposite polarities and of substantially equal amplitudes, and said second data signal comprises two consecutive pulses of opposite polarities to the pulses of said first data signal and of substantially equal amplitudes.

3. A method as claimed in claim 1, wherein said first data signal comprises a constant dc level, and said second data signal comprises two consecutive pulses of polarities opposite to those of the pulses of the strobing signal.

4. A method as claimed in claim 1, wherein said first data signal comprises two consecutive pulses of the same polarities as the pulses of the strobing signal, and said second data signal comprises a constant dc level.

5. A method as claimed in claim 1, wherein said first and second pulses of the strobing signal are of mutually different time durations.

6. A method as claimed in claim 1, wherein each first and second data signal comprises two pulses of mutually opposite polarities and of mutually different time durations.

7. A method as claimed in claim 1, wherein the strobing signal and/or each first and second data signal comprises two pulses of mutually opposite polarities separated by a period of zero voltage.

8. A method as claimed in claim 1, wherein a relatively high-frequency ac voltage is superimposed on the strobing signal and/or the data signal.

9. Apparatus for driving a ferroelectric liquid crystal device matrix in a time-division multiplex mode, comprising the steps of: applying strobing signals cyclically to strobe lines coupled to two-state liquid crystal elements of the display; and applying data signals selectively to data lines coupled to the elements; wherein each strobing signal comprises, during each frame period, only two strobe pulse periods, during which there are a first pulse of one polarity followed by a second pulse of the opposite polarity and of different amplitude and/or duration from the first pulse, each strobing signal including, between successive frame periods, a dc voltage which is effective during a period between the end of the second strobe pulse of a said strobing signal and the beginning of the first strobe pulse of the next strobing signal applied to the same strobe line to substantially cancel a dc voltage level resulting from the difference between the amplitudes and/or durations of the first and second strobe pulses, and which dc voltage will not switch the liquid crystal elements during said period; wherein the data signals comprise selectively a first data signal or a second data signal, said first data signal being operative in combination with the strobing signal to set a selected liquid crystal element in a first one of its states, and said second data signal being operative in combination with the strobing signal to set the selected liquid crystal element in the other of its states; and wherein one of each of the first and second data signals comprises two consecutive pulses of opposite polarities, there being only two data pulse periods in a frame period, said data pulse periods being substantially coincident with the strobe pulse periods.

* * * * *